US005294203A

United States Patent [19]

Williams

[11] Patent Number: 5,294,203

[45] Date of Patent: Mar. 15, 1994

[54] INK RIBBON FEED

[75] Inventor: Thomas D. Williams, Billericay, United Kingdom

[73] Assignee: Alcatel Business Systems Limited, Essex, United Kingdom

[21] Appl. No.: 814,452

[22] Filed: Dec. 30, 1991

[30] Foreign Application Priority Data

Dec. 31, 1990 [GB] United Kingdom ..... 9028226.0

[51] Int. Cl.[5] ..... B41J 2/325

[52] U.S. Cl. ..... 400/120; 400/223; 400/225

[58] Field of Search ..... 400/225, 120, 223, 234, 400/236, 236.2, 207, 208

[56] References Cited

U.S. PATENT DOCUMENTS

| | | | |
|---|---|---|---|
| 3,882,774 | 5/1975 | Pfiz | 101/336 |
| 4,025,830 | 5/1977 | Delaporte | 400/225 |
| 4,705,417 | 11/1987 | Harry | 400/208 |
| 4,723,853 | 2/1988 | Suzaki et al. | 400/120 |
| 4,813,802 | 3/1989 | Gilham et al. | 400/74 |
| 4,821,644 | 4/1989 | Gawler | 400/154.4 |
| 4,924,240 | 5/1990 | Herbert et al. | 400/120 |

FOREIGN PATENT DOCUMENTS

| | | | |
|---|---|---|---|
| 0096889 | 6/1982 | Japan | 400/234 |
| 0115367 | 7/1982 | Japan | 400/120 |
| 0125383 | 5/1988 | Japan | 400/234 |
| 2139964 | 11/1984 | United Kingdom . | |

OTHER PUBLICATIONS

W. M. Jenkins "End-of-Ribbon Sensor and Cartridge-Present Indicator" IBM Technical Disclosure Bulletin. vol. 27, No. 6 Nov. 1984.

*Primary Examiner*—Edgar S. Burr
*Assistant Examiner*—Anthony H. Nguyen
*Attorney, Agent, or Firm*—Shoemaker and Mattare

[57] ABSTRACT

Thermal printing apparatus is disclosed in which a thermal transfer ink ribbon (14) is drawn from a supply spool (15) past a thermal print head (12) in ink transfer engagement with an item (17) on which printing is to be effected. The used ribbon is wound upon a take up spool (16) which is driven to apply tension to the used ribbon to peel it from the face of the printed item. Drive (43) to the take up spool is controlled by a pivoted member (22) which actuates a switch (26) to apply drive when the ribbon is slack and to terminate energisation of the drive as the ribbon becomes taut.

3 Claims, 4 Drawing Sheets

INK RIBBON FEED

BACKGROUND OF THE INVENTION

This invention relates to apparatus for feeding ink ribbons and in particular for feeding thermal transfer ink ribbons and controlling the winding of used ribbon onto a take-up spool.

Ink ribbons for printing on a print receiving medium are commonly fed from a supply spool past a printing head where printing is effected and then the used ribbon is wound onto a take-up spool. Thermal transfer ink ribbons are usually maintained stationary relative to the print receiving medium and relative movement is effected between a thermal print head and the combination of thermal ink transfer ribbon and the print receiving medium. The thermal print head may be stationary and the print receiving medium together with the ribbon is fed past the print head. The thermal transfer ink ribbon extends between the elements of the print head and the print receiving medium. Printing is effected by selectively heating thermal printing elements arranged in a row on the print head during movement of the ribbon and medium past the elements. Heating of an element results in melting of the ink layer in the vicinity of the heated element and the melted ink is deposited on the surface of the ink receiving medium. Successive selective heating of the elements effects line by line printing of dots in selected positions to build up complete characters or patterns. Transfer of ink from the ribbon requires that the print receiving medium is urged into intimate contact with an ink layer of the ribbon. This is accomplished by means of a pressure roller which resiliently urges the print receiving medium into contact with the ribbon and the back of the ribbon into heat transfer engagement with the printing elements of the print head. When the print receiving medium is fed past the print head, the intimate contact between the ribbon and the print receiving medium ensures that sufficient frictional force is applied by the print receiving medium on the ribbon to feed the ribbon at the same speed as the feeding of the medium. Accordingly no additional feeding means are required to feed the ribbon with the medium.

After passage of the ribbon past the thermal print head, the used ribbon is peeled from the surface of the print receiving medium to leave the deposited ink pattern on the medium. The used ribbon tends to adhere to the print receiving medium and accordingly it is necessary to apply a small tension force to the used ribbon in a direction at an angle to the surface of the medium. Furthermore it is convenient to wind the used ribbon onto a take up spool to retain the used ribbon within the machine until subsequent disposal of the used ribbon. The tension required to peel the ribbon from the medium may be applied to the ribbon by rotationally driving the take up spool to wind the ribbon thereon. This is achieved by driving the take up spool such that it tends to wind the ribbon faster than the ribbon issues from the print head. The drive tot he take up spool may be through a slipping clutch or the drive motor may be stalled when the ribbon is under tension.

It is proposed to use thermal transfer printing in franking machines for printing franking impressions on mail items. The mail item is fed into the machine and is pressed into contact by means of a pressure roller with a thermal transfer ribbon in the vicinity of a thermal print head. As the mail item is fed past the print head, together with the ribbon, the franking impression is built up line by line by rows of printed dots. Upon completion of printing of the franking impression, the pressure roller is retracted to release the mail item to permit the item to be ejected from the machine. When the pressure roller is retracted to release the mail item, the mail item no longer imposes any restraint upon travel of the ribbon and as a result the tension applied to the ribbon to peel it from the mail item during printing of a franking impression tends to draw additional ribbon from the supply spool and wastage of ribbon occurs between consecutive franking operations.

SUMMARY OF THE INVENTION

According to a first aspect of the invention thermal printing apparatus includes a print head comprising a plurality of selectively heatable thermal printing elements; means to feed a print receiving medium past the thermal printing elements; means to guide a thermal transfer ink ribbon between the thermal printing elements and the print receiving medium, said ribbon having an ink layer adjacent to the print receiving medium; pressure means to urge the print receiving medium into intimate contact with the ink layer of the ribbon and to urge the ribbon into heat transfer relationship with the thermal printing elements, said intimate contact between the ink layer and the print receiving medium being effective to feed the ribbon with the print receiving medium; driven take up means to draw used ribbon from the print head; drive means to drive said take up means to apply tension to said used ribbon; sensing means response to the used ribbon being in a non-tensioned state to energise said drive means and responsive to the used ribbon being in a tensioned state to terminate energisation of the drive means.

According to a second aspect of the invention a franking machine incorporates thermal printing apparatus as hereinbefore defined.

BRIEF DESCRIPTION OF THE DRAWING

An embodiment of the invention will now be described by way of example with reference to the drawings in which.

DESCRIPTION OF THE PREFERRED EMBODIMENT

Figure 1:
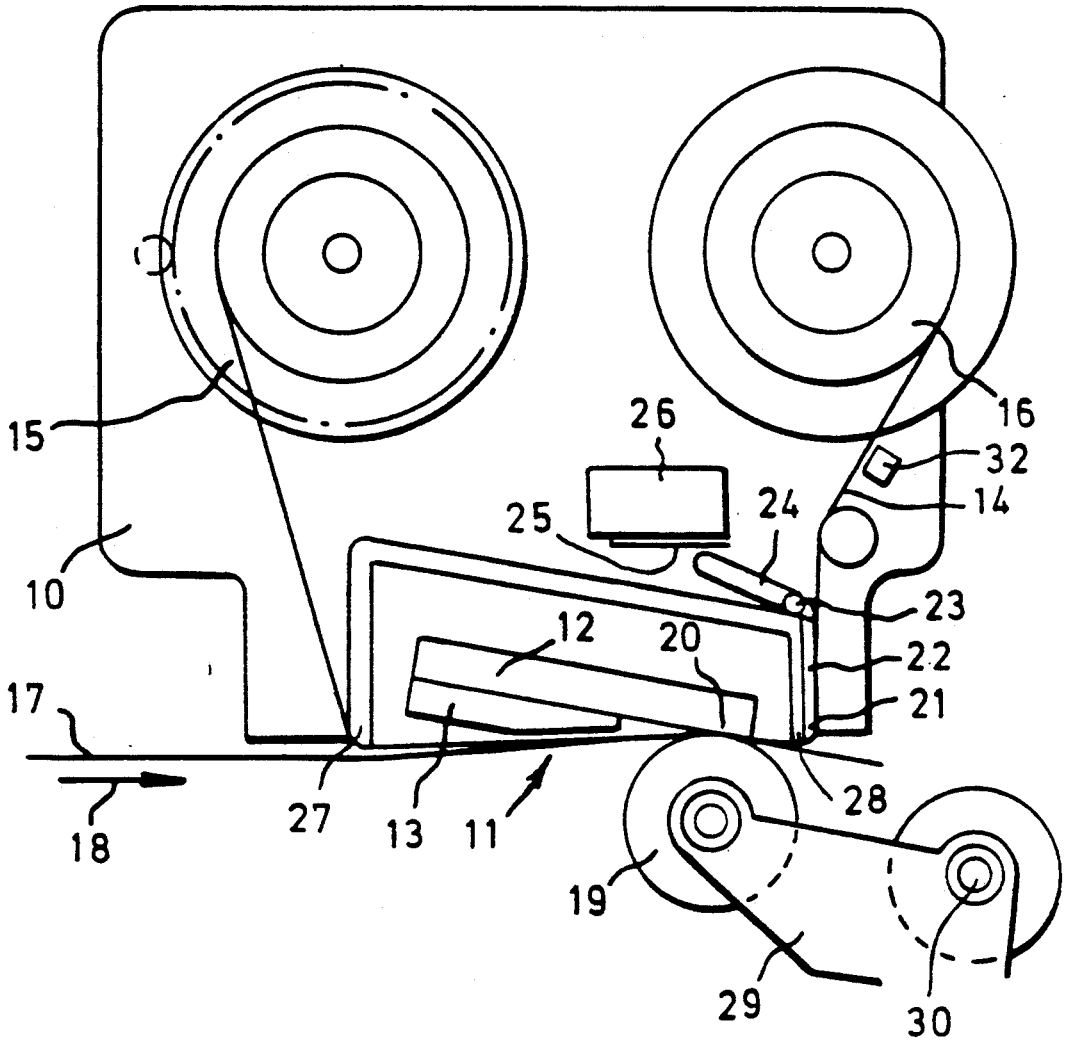
FIG. 1 is a view of a thermal transfer printing device.

Referring first to FIG. 1, a thermal transfer printing device comprises a thermal print head 11 and a thermal transfer ink ribbon cassette 10. The thermal print head 11 comprises a substrate 12 carrying a line of thermal printing elements which are selectively energised with electric currents by means of print head drive circuits 13. The thermal transfer ink ribbon cassette includes a spool 15 of unused ink ribbon 14 from which the ribbon is drawn in a printing operation and a spool 16 to take up used ribbon after it has been used in printing. The thermal transfer ink ribbon 14 comprises a backing layer carrying a layer of ink and the ribbon is fed from the supply reel 15 past the thermal printing elements of the print head 11 to the take up reel 16. A mail item 17 such as an envelope or postage label is fed, in the direction of arrow 18, past the thermal printing elements of the print head 11 and is pressed toward the thermal printing elements by means of an impression roller 19. The thermal transfer ink ribbon 14 is guided by guides 27, 28 and passes between the mail item and the print head. The thermal printing elements are disposed along a line, indicated by reference 20, parallel to the axis of impression roller 19 so that the printing elements lie on a line on which the impression roller exerts pressure toward the print head. As the mail item 17 is fed past the print head, in engagement with the ink layer of the ribbon 14, frictional engagement between the mail item and the ribbon causes the ribbon to be pulled along by the mail item. As the mail item and the ribbon are fed past the print head, the thermal elements of the head are energised selectively to cause selective heating thereof such that those elements which are energised heat areas of ink adjacent to the heated elements and thereby cause those areas of ink to be transferred to the surface of the mail item. Successive selective energisations of the elements during feeding of the mail item builds up, line by line, a desired printed pattern on the mail item. Feeding of the mail item causes the ribbon to be pulled from the supply reel 15. After passing the print head the ribbon is guided by guide 28 to the take up spool 16. A motor drive is coupled through a slipping clutch to the take up spool to rotate the spool to take up the used ribbon. The feed path of the ribbon from the guide 28 to the take-up spool 16 extends at an angle to the path of the mail items so that by applying tension to the ribbon through rotation of the up spool, the ribbon is peeled from the surface of the mail item.

During printing of the franking impression, the impression roller 19 is resiliently urged toward the thermal elements of the print head to maintain the mail item in intimate contact with the ink layer of the ribbon 14 and to maintain the ribbon in heat transfer relationship with the thermal elements. The contact between the mail item and the ribbon causes the ribbon to be drawn from the supply spool and to be fed at the same speed as the mail item. When printing of the franking impression by successive selected energisations of the printing elements has been completed, the impression roller is moved away from the print head. The impression roller is mounted in a cradle 29 pivoted about an axis 30 and by pivoting of the cradle the impression roller is moved between its operative position resiliently urged toward the print head and an inoperative retracted position. When the impression roller is moved away from its operative position, the mail item is no longer pressed into contact with the ink ribbon 14 and therefore the ribbon is no longer constrained to be fed at the speed of feed of the mail item. In order to ensure that the used ribbon is peeled from the mail item and is wound onto the take up spool 16 the drive to the spool must be such that the spool tends to wind the ribbon at least as fast as the ribbon passes the guide 28 and in practice the speed of the drive must be such as to tend to wind the ribbon at a faster speed than the ribbon passes the guide 28. It will be appreciated that this speed of drive is required when the diameter of the wound ribbon is a minimum and consequently as the diameter of the wound ribbon increases towards its maximum the speed at which the drive tends to wind the ribbon increases. When the impression roller is moved away from its operative position the constraint exerted by the mail item on the ribbon is removed and the drive for the take up spool will tend to continue to draw further ribbon from the supply spool. As a result unused ribbon is drawn beyond the print head and is wasted. De-energisation of the drive to the take up spool at the time that the impression roller is retracted terminates the tension force tending to pull further tape from the supply spool but it has been found that there is a tendency for over-travel of the ribbon and resultant wastage of ribbon.

Figure 2:
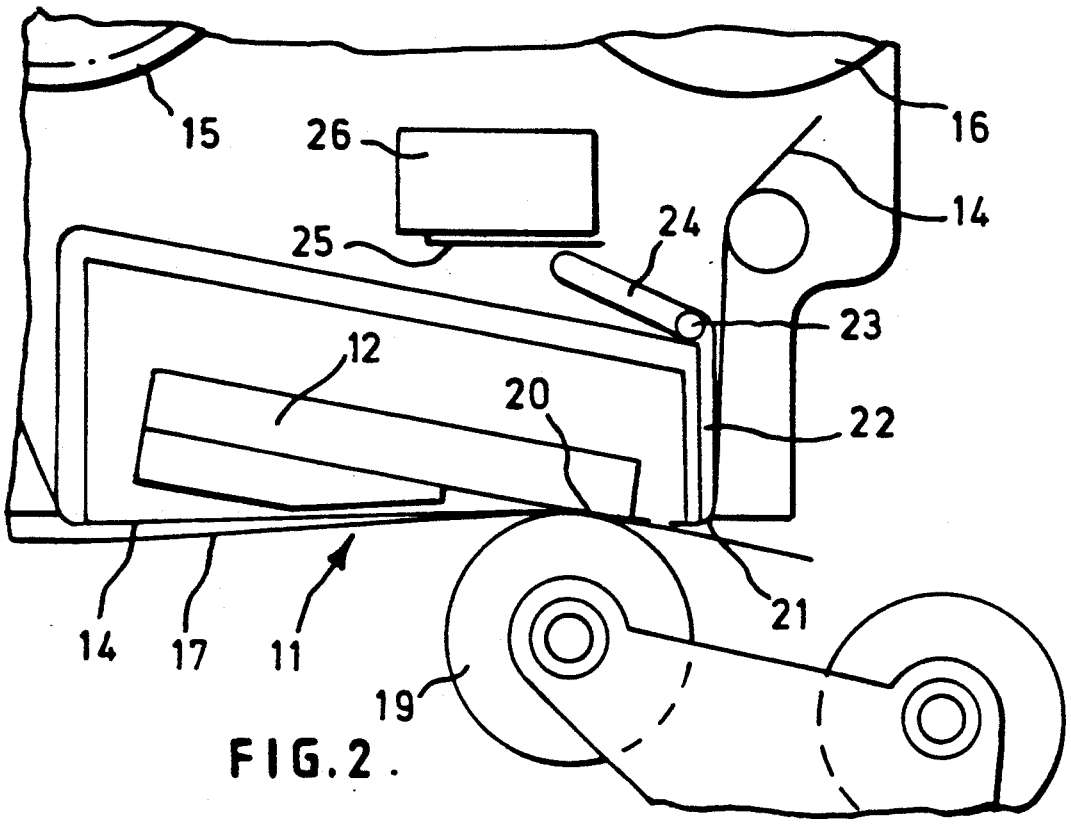
FIG. 2 is a view to an enlarged scale of a part of the printing device showing a ribbon sensor when ribbon between the print head and a supply reel is under tension.
Figure 3:
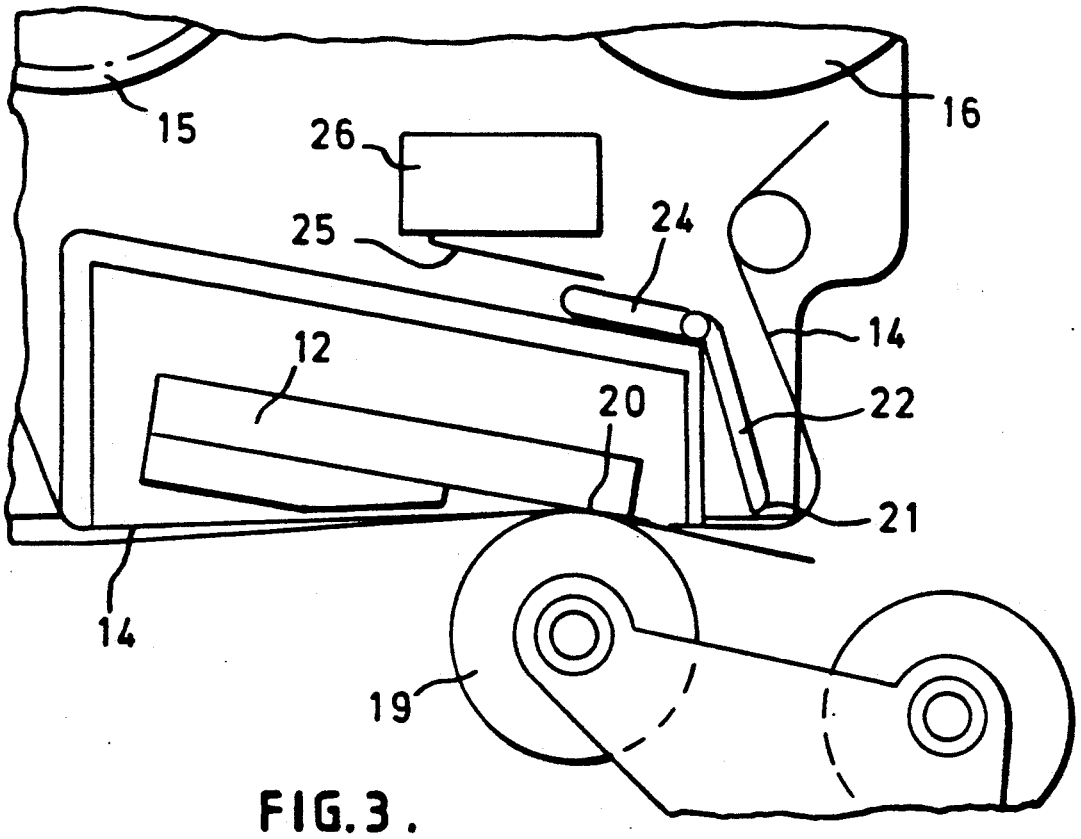
FIG. 3 is a view similar to that of FIG. 2 illustrating the ribbon sensor when ribbon between the print head and the supply reel is not under tension.
Figure 5:
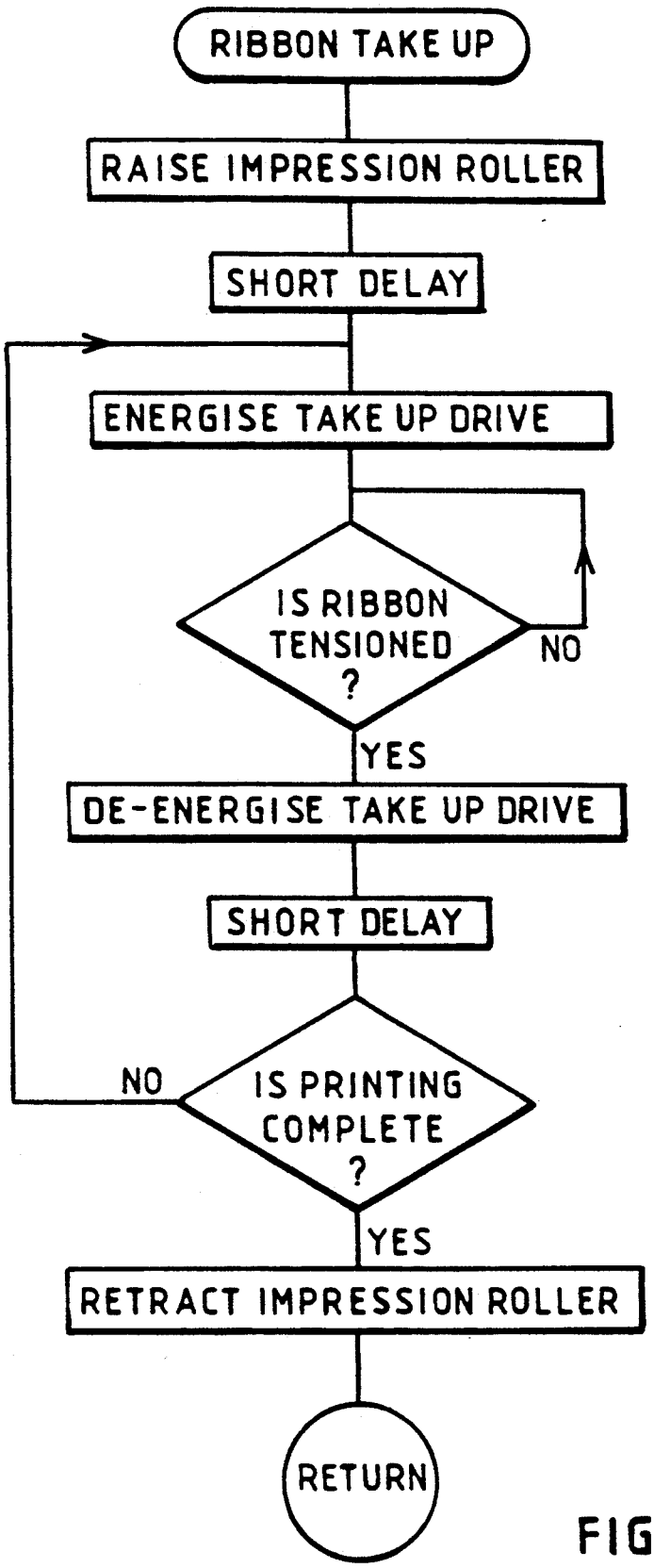
FIG. 5 is flow chart illustrating control of take up means for used ribbon.

In order to reduce wastage of ribbon, the drive to the take up spool is controlled in dependence upon a sensor device responsive to tension in the ribbon. The sensor device includes a guide surface 21 on the end of a pivoted flap 22 mounted adjacent the guide 28. The flap is pivoted at 23 and is provided with an extension arm 24 which engages an operating lever 25 of a microswitch 26. The microswitch includes a spring resiliently urging the operating lever in a clockwise direction, as shown in the drawings, and through the engagement between the lever 25 and the extension 24 resiliently urges the flap 22 in an ant-clockwise direction. When drive is applied to the take-up reel 16, tension is applied tot he ribbon and this tends to pivot the flap in a clockwise direction, against the action of the microswitch spring, to lie against the guide 28 as shown in FIG. 1. This is shown more clearly in the illustration to an enlarged scale of FIG. 2. When the flap approaches the position shown in FIG. 2, the arm 24 depresses the lever 25 and thereby operates the microswitch to terminate energisation of the drive to the take up spool 16. Initially at the start of printing a franking impression, the pressure roller is in a retracted position and the mail item is fed into the gap between the pressure roller and the print head. The pressure roller is then raised to its operative position to press the mail item toward the print head. Accordingly as the mail item and the ribbon drawn thereby are fed past the print head, the ribbon between the print head and the take-up spool becomes slack and the flap 22 is freed to pivot anti-clockwise to a position as shown in FIG. 3. In this position of the flap, the lever of the micro-switch is released to permit the micro-switch to re-energise the drive for the take-up spool and after a short delay the drive to the take up spool is energised. Thus during a printing operation in which the ribbon is drawn by the feeding of the mail item, the drive to the take-up spool is repeatedly energised and de-energised to alternately tension and permit slackness in the ribbon. The repeated energisation and de-energisation is illustrated by the flow chart of FIG. 5. When the impression roller is moved upon completion of printing of a franking impression on the mail item, tension imposed in the ribbon by energisation of the drive to the take-up spool which is sufficient to draw ribbon from the supply spool is effective to pivot the flap 22 to the position shown in FIG. 2 and thereby cause termination of the energisation of the drive. The drive to the take-up spool is deactivated via the microprocessor 35, input/output interface 39 and buffer 44 until such time as the next mail item is fed to the print head and the impression roller is moved to its operative position to cause feeding of the ribbon by the mail item. The control of the energisation of the take up spool drive in dependence upon sensing of the ribbon tension by the sensor prevents excessive over-travel of the ribbon when the mail item is released by the impression roller. A fixed guide or roller 31 is provided to define the direction in which the ribbon is pulled as it leaves the guide 28 so that the direction of application of tension to the ribbon is constant regardless of the diameter of wound ribbon on the spool 16. Instead of utilising a micro-switch to provide an indication of the position of the sensor flap 22 other devices such as an opto-sensor or a hall effect device may be used. The sensor flap 22 may be provided as a component of the ribbon cassette while the micro-switch or other device may be mounted on the frame of the franking machine. When using devices which do not incorporate a spring, a spring is provided to urge the flap to pivot against the tension in the ribbon. Alternatively, the sensor may be designed such that the action of gravity on the elements thereof provides the required force to urge the flap to pivot against the ribbon tension.

As hereinbefore described it is envisaged that initially, the supply spool is filled with ribbon and that in the course of printing operations in which franking impressions are printed the ribbon is successively transferred to the initially empty take up spool. However the ribbon feed may be operated in such a manner that initially the spool is full of unused ribbon and that prior to printing each franking impression a length of ribbon sufficient to enable printing of that printing impression is present on the spool 15. Thus during printing of each franking impression the ribbon is drawn from the spool 15 and wound onto spool 16 as hereinbefore described but in an interval between printing of successive franking impressions the ribbon is fed in the reverse direction to provide a sufficient length of ribbon on the spool 15 for ink transfer for the next franking impression.

During this reverse feeding of the ribbon in intervals between printing, sensing of the ribbon drawn from spool 16 may be effected to detect when the supply of ribbon from the spool 16 becomes exhausted. Accordingly any indication of exhaustion of the ribbon supply is generated prior to commencement of printing and as a result initiation of further franking operations including accounting for value of postage charge and printing of the franking impression can be inhibited when the ribbon supply is exhausted.

To accomplish the reverse feeding of the ribbon during intervals between printing a drive is provided for the spool 15 and this drive is energised during reverse feeding to draw ribbon from the spool 16. Reverse feeding of the ribbon imposes sufficient tension in the ribbon to pivot the flap 22 of the ribbon sensor to the position shown in FIG. 2. Accordingly the resultant operation of the microswitch indicates that the ribbon is under tension and that there is a supply of ribbon on the spool 16. However if ribbon supply from spool 16 becomes exhausted, or if the ribbon should break, the flap 22 is not retained in this position and the state of the microswitch provides an indication of ribbon exhaustion or breakage. If desired instead of using the sensor comprising the flap 22 to indicate exhaustion of the ribbon, a separate sensor 32 may be provided. The sensor 32 is mounted to sense the ribbon between the guide 28 and the spool 16 and may be responsive to opaque or reflective material at the end of the ribbon.

It will be appreciated that the ribbon cassette is removable from the franking machine to enable replacement of the cassette with a cassette containing unused ribbon when required. Conveniently the flap 22 is mounted on the cassette and the micro-switch 26 is mounted on the frame of the printing apparatus. The extension arm 24 has a form such that it extends from the cassette to engage the operating lever of the microswitch.

Instead of housing the ribbon in a cassette, the ribbon may be provided on spools or reels which can be removably mounted on the franking machine. Whichever manner of providing for replacement of the ribbon is utilised, the franking machine is provided with drive means to engage and drive one or both of the spools.

Figure 4:
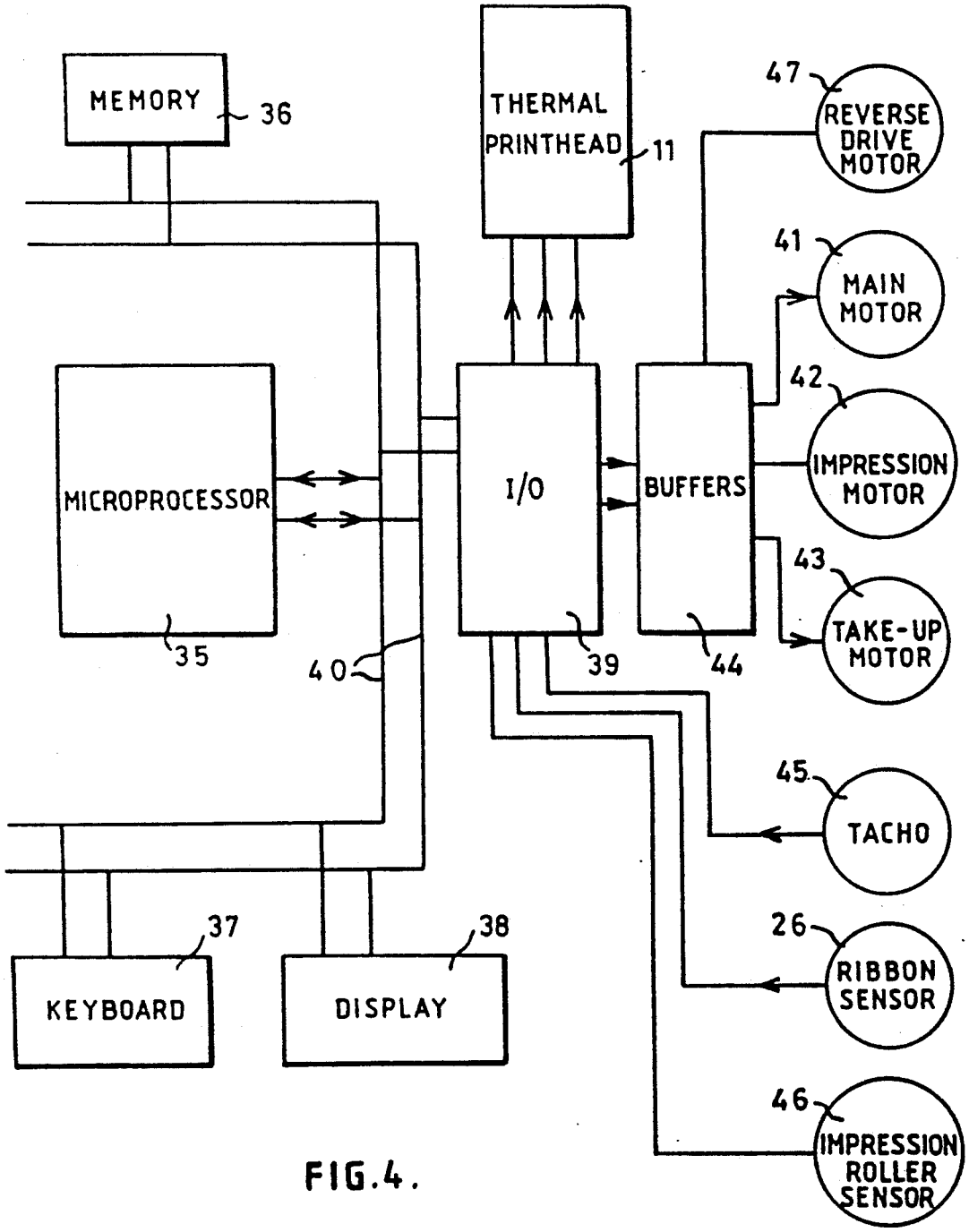
FIG. 4 is a block diagram of a control circuit for a franking machine incorporating the printing device of FIG. 1.

Referring now to FIG. 4, the franking machine includes a micro-processor 35 which carries out control and accounting functions under the control of one or more program routines stored in memory 36. Data such as required postage values and control signals are input to the microprocessor by means of a keyboard 37 and information output by the microprocessor for display to a user of the franking machine is displayed by a display device 38. Print data output signals from the microprocessor for control of operation of the thermal printing elements 20 of print head 11 are transmitted to the print head drive circuits 13 via an input/output interface 39. Although the memory 36 is shown as a single block it includes separate memory devices including a read only memory for storing program routines for control of operation of the microprocessor and non-volatile memory devices for storing accounting data. As is well known in the franking machine art, the non-volatile memory devices for accounting data are arranged to store a number of replications of the data to enable integrity of the data to be checked and to recover the accounting data in the event of a fault. The memory 36, keyboard 37, display 38, input/output interface 39 are connected to the microprocessor 35 by means of a common bus 40. A motor drive 41 for driving means for feeding the mail item 17 past the print head, a motor drive 42 for moving the cradle 29 of the impression roller and a motor drive 43 for rotating the take up spool 16 are energised selectively by drive control signals output from the microprocessor via the input/output interface 39 and buffers 44. Where drive is required to be applied to the spool 15 a further motor drive 47 is provided and connected to the buffers 44.

A tachometer 45 is coupled to the feed means for the mail item to generate pulses as the mail item is fed past the print head which are input to the microprocessor 35. The microprocessor utilises the pulses from the tachometer to strobe energisation of the print head elements to ensure that successive energisations of the thermal printing elements is synchronised with movement of the mail item. Thus the strobing of the print elements in dependence upon the timing of the pulses from the tachometer ensures that the successive lines of dots are printed at substantially equally spaced positions on the mail item. A sensor 46 is provided to generate signals to indicate whether the impression roller is in its raised operative position or in its retracted in-operative position.

I claim:

1. Thermal printing apparatus including a print head comprising a plurality of selectively heatable thermal printing elements; means to feed a print receiving medium past the thermal printing elements; a thermal transfer ink ribbon and means to guide said thermal transfer ink ribbon between the thermal printing elements and the print receiving medium, said ribbon having an ink layer adjacent to the print receiving medium; pressure means to urge the print receiving medium into intimate contact with the ink layer of the ribbon and to urge the ribbon into heat transfer relationship with the thermal printing elements, said intimate contact between the ink layer and the print receiving medium being effective to feed the ribbon with the print receiving medium; driven take up means to draw used ribbon from the print head; a guide edge disposed between said print head and said take up means, drive means to drive said take up means to apply tension to said used ribbon in a direction at an angle from the surface of the print receiving medium such that the used ribbon wraps around the guide edge and is drawn from the surface of the print receiving medium; sensing means comprising a pivoted member having a free end engaged by the used ribbon when the ribbon is in a tensioned state to pivot the member to a first position with its free and adjacent said guide edge and means resiliently urging said pivoted member toward a second position in which said free end is spaced away from said guide edge, and said sensing means including means to generate an electrical signal when the member is in one of said positions to control energization of the drive means, said sensing means being responsive to the used ribbon being in a non-tensioned state to energize said drive means and responsive to the used ribbon being in a tensioned state to terminate energization of the drive means.

2. Thermal printing apparatus as claimed in claim 1 including a ribbon supply spool and wherein the ribbon is fed from said supply spool in a first direction by means of the intimate contact between the ink layer and the print receiving medium during a printing operation and including reverse drive means to drive said supply spool to feed said ribbon in a reverse direction opposite to said first direction from the take up means to said supply spool during an interval between successive printing operations; wherein the pressure means comprises a pressure roller movable between an operative position to apply pressure to said print receiving medium during said printing operation and an inoperative retracted position during said interval and wherein the means to generate an electrical signal is responsive during feeding of said ribbon in said reverse direction in said interval to generate a fault signal when the free end of the member is in the second position spaced from the guide edge.

3. Thermal printing apparatus as claimed in claim 1, further including accounting and control means; input means connected to said accounting and control means; memory means connected to said accounting and control means for storing accounting data; and said accounting and control means being connected to the plurality of thermal printing elements to control selective heating of said elements during feeding of the print receiving medium past said elements by the feeding means to print a franking impression representing said input postage value.

* * * * *